US009357315B2

(12) United States Patent
Sunohara et al.

(10) Patent No.: US 9,357,315 B2
(45) Date of Patent: May 31, 2016

(54) HEARING AID, LOUDSPEAKER, AND FEEDBACK CANCELLER

(71) Applicant: RION Co., Ltd., Tokyo (JP)

(72) Inventors: Masahiro Sunohara, Tokyo (JP); Kazuteru Nishiyama, Tokyo (JP)

(73) Assignee: RION CO., LTD., Kokubunji-Shi, Tokyo (JP)

( * ) Notice: Subject to any disclaimer, the term of this patent is extended or adjusted under 35 U.S.C. 154(b) by 91 days.

(21) Appl. No.: 14/477,126

(22) Filed: Sep. 4, 2014

(65) Prior Publication Data

US 2015/0071454 A1 Mar. 12, 2015

(30) Foreign Application Priority Data

Sep. 6, 2013 (JP) ..... 2013-185736

(51) Int. Cl.
*G10K 11/16* (2006.01)
*H04R 25/00* (2006.01)
*H04R 3/02* (2006.01)

(52) U.S. Cl.
CPC ..... *H04R 25/453* (2013.01); *H04R 3/02* (2013.01); *H04R 2225/43* (2013.01); *H04R 2430/01* (2013.01)

(58) Field of Classification Search
None
See application file for complete search history.

(56) References Cited

U.S. PATENT DOCUMENTS

| | | | | |
|---|---|---|---|---|
| 6,580,794 | B1 * | 6/2003 | Ono | 379/406.08 |
| 2003/0053647 | A1 * | 3/2003 | Kates | 381/318 |
| 2005/0015252 | A1 * | 1/2005 | Marumoto | 704/234 |
| 2006/0008076 | A1 * | 1/2006 | Okumura et al. | 379/406.01 |
| 2006/0140429 | A1 | 6/2006 | Klinkby et al. | |
| 2006/0172272 | A1 * | 8/2006 | Okumura | 434/307 A |
| 2011/0150257 | A1 * | 6/2011 | Jensen et al. | 381/318 |
| 2011/0188686 | A1 * | 8/2011 | Munk | 381/318 |
| 2013/0272533 | A1 * | 10/2013 | Kojima et al. | 381/66 |
| 2014/0321682 | A1 * | 10/2014 | Kofod-Hansen et al. | 381/315 |

FOREIGN PATENT DOCUMENTS

| | | |
|---|---|---|
| EP | 0 581 261 | 2/1994 |
| JP | H06-189397 | 7/1994 |
| JP | 2007-515820 | 6/2007 |
| WO | 2005/020632 | 3/2005 |

* cited by examiner

*Primary Examiner* — Thang Tran
(74) *Attorney, Agent, or Firm* — Troutman Sanders LLP

(57) ABSTRACT

A hearing aid includes: a microphone; a hearing aid processing unit configured to provide a gain to a first signal based on an output signal from the microphone to generate a second signal; a receiver configured to convert the second signal into sound; an adaptive filter configured to adaptively estimate a transfer function corresponding to a pathway from an input side of the receiver to an output side of the microphone; and a feedback removal unit configured to subtract a third signal generated based on the transfer function from the output signal of the microphone to obtain a signal and output the signal as the first signal; and a control unit configured to control the gain setting unit and an adaptive speed of the adaptive filter.

10 Claims, 5 Drawing Sheets

HEARING AID, LOUDSPEAKER, AND FEEDBACK CANCELLER

CROSS-REFERENCE TO RELATED APPLICATION

This application claims priority from Japanese Patent Application No. 2013-185736 filed with the Japan Patent Office on Sep. 6, 2013, the entire content of which is hereby incorporated by reference.

BACKGROUND

1. Technical Field

The present disclosure relates to a hearing aid, a loudspeaker, and a feedback canceller that include configurations capable of suppressing occurrence of feedback.

2. Related Art

In general, a hearing aid includes a microphone for collecting sound transmitted from external space and a receiver for outputting the sound to the external ear canal of a user. Thus, feedback may occur when the output sound from the earphone is fed back to the microphone. Feedback cancellers are known as devices for suppressing occurrence of such feedback. Among them, a feedback canceller using an adaptive filter for adaptively estimating a feedback transfer function can be effectively installed in a hearing aid implementing digital signal processing.

Usually, when the adaptive speed of the adaptive filter is set at a high level, the transfer function converges quickly. However, this increases errors and makes entrainment prone to occur. The entrainment refers to a phenomenon that an input signal close to a sinusoidal wave is distorted due to malfunction of a feedback canceller using an adaptive filter in a hearing aid.

Therefore, it is not preferred that the adaptive speed of the adaptive filter be kept high.

On the other hand, when the adaptive speed of the adaptive filter is set low, the accuracy of estimation improves and entrainment is less prone to occur. In this case, however, it takes time to converge the transfer function. Thus, there have been suggested feedback cancellers that appropriately control the adaptive speed of the adaptive filter depending on situations (for example, refer to JP-A H6-189397 and JP-A 2007-515820).

For instance, in the feedback canceller included in the hearing aid disclosed in JP-A H6-189397, the adaptive filter operates at a low adaptive speed at normal times. Upon occurrence of feedback, the adaptive speed of the adaptive filter is switched to high by a manual switch.

In addition, for instance, in the feedback canceller included in the hearing aid disclosed in JP-A 2007-515820, the adaptive speed of the adaptive filter is changed according to the magnitude of a difference between an input signal and an error signal.

SUMMARY

A hearing aid includes: a microphone configured to convert sound into an electric signal; a hearing aid processing unit including a gain setting unit configured to provide a gain to a first signal generated based on an output signal from the microphone to generate a second signal; a receiver configured to convert the second signal into sound; a feedback removal unit including an adaptive filter configured to adaptively estimate a transfer function corresponding to a pathway from an input side of the receiver to an output side of the microphone through transmission of the sound, a coefficient update unit configured to update a filter coefficient of the adaptive filter based on the first signal and the second signal and a subtraction unit configured to subtract a third signal generated based on the transfer function from the output signal of the microphone to obtain a signal and output the signal as the first signal; and a control unit configured to control at least the gain setting unit and an adaptive speed of the adaptive filter, wherein the coefficient update unit updates the filter coefficient based on an amount of updating normalized by power of input, and the control unit sets a smaller gain than a gain under normal operation to the gain setting unit until a first time has elapsed since immediately after power-on and sets a higher adaptive speed than an adaptive speed under normal operation to the adaptive filter until a second time has elapsed since immediately after the power-on.

DETAILED DESCRIPTION

Figure 1:
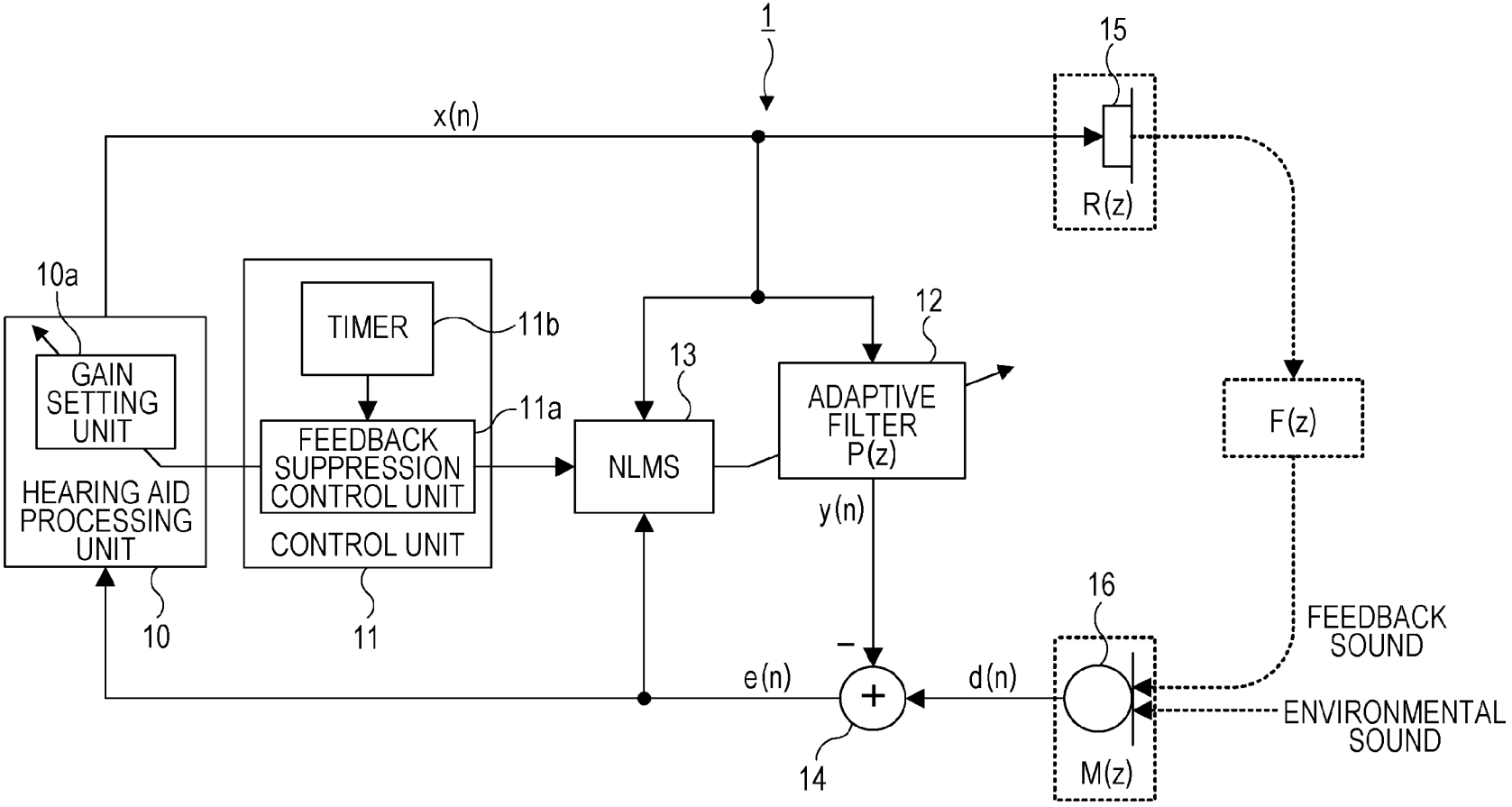
FIG. 1 is a block diagram illustrating a specific example of the configuration of digital signal processing in a hearing aid according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In general, immediately after power-on of the hearing aid, the feedback transfer function is estimated from zero by the adaptive filter. According to this method, if the hearing aid is given a sufficient gain, the estimation of the feedback transfer function does not converge immediately after power-on, and feedback is prone to occur. Thus, even the hearing aid with a feedback canceller can produce its effects only after a lapse of a sufficient time since the power-on. Accordingly, for a predetermined period of time immediately after power-on, feedback occurs and causes discomfort to the user. In this regard, the feedback cancellers disclosed in JP-A H6-189397 and JP-A 2007-515820 do not handle occurrence of feedback immediately after the power-on.

According to the feedback cancellers disclosed in JP-A H6-189397 and JP-A 2007-515820, the feedback transfer function can be estimated in a short time by setting high adaptive speed of the adaptive filter immediately after the power-on. However, according to the technique described in JP-A H6-189397, it is necessary to perform a troublesome operation of using a manual switch to increase the adaptive speed of the adaptive filter at each power-on. In this case, if the adaptive speed of the adaptive filter is increased, the time during which feedback occurs can be shortened but the occurrence of feedback cannot be surely prevented. In addition, according to the technique described in JP-A 2007-515820, the adaptive speed of the adaptive filter is switched after the magnitude of a difference between an input signal and an error signal is determined. Thus, even if the switching takes place in an appropriate manner, the time during which feedback is prone to occur can be merely shortened. Further, if the initial setting or the switching is not appropriate, it may take time to suppress the feedback.

One object of the present disclosure is to provide a hearing aid and the like comfortable to the user, which has a relatively simple configuration and can suppress occurrence of feedback immediately after power-on of the hearing aid.

A hearing aid (1) according to an embodiment of the present disclosure includes: a microphone (16) configured to convert sound into an electric signal; a hearing aid processing unit (10) including a gain setting unit (10*a*) configured to provide a gain to a first signal generated based on an output signal from the microphone to generate a second signal; a receiver (15) configured to convert the second signal into sound; a feedback removal unit including an adaptive filter (12) configured to adaptively estimate a transfer function corresponding to a pathway from an input side of the receiver to an output side of the microphone through transmission of the sound, a coefficient update unit (13) configured to update a filter coefficient of the adaptive filter based on the first signal and the second signal and a subtraction unit (14) configured to subtract a third signal generated based on the transfer function from the output signal of the microphone to obtain a signal and output the signal as the first signal; and a control unit (11) configured to control at least the gain setting unit and an adaptive speed of the adaptive filter, wherein the coefficient update unit updates the filter coefficient based on an amount of updating normalized by power of input, and the control unit sets a smaller gain than a gain under normal operation to the gain setting unit until a first time has elapsed since immediately after power-on and sets a higher adaptive speed than an adaptive speed under normal operation to the adaptive filter until a second time has elapsed since immediately after the power-on.

According to the hearing aid of the present disclosure, the estimation of the transfer function by the adaptive filter has not yet converged until the second time has elapsed since immediately after the power-on of the hearing aid. To handle this issue, control is performed such that occurrence of feedback can be suppressed by decreasing the gain as compared to that under normal operation and the transfer function can be estimated in a short time by increasing the adaptive speed of the adaptive filter. Accordingly, it is possible to reliably suppress occurrence of feedback immediately after the power-on of the hearing aid without having to introduce any complicated configuration or control.

In the hearing aid according one embodiment of the present disclosure, the coefficient update unit desirably employs a normalized least mean square (NLMS) algorithm. With the employment of the NLMS algorithm, the amount of updating is normalized by power of input from past to present. This makes it possible to set the adaptive speed of the adaptive filter not depending on the magnitude of power.

In the hearing aid according to one embodiment of the present disclosure, the gain-setting unit and the adaptive speed of the adaptive filter can be controlled by the control unit in various manners. For example, it is available to employ the control that sequentially make the gain increase in plural steps until the first time has elapsed since immediately after the power-on. In addition, the gain can be increased smoothly in a sufficiently increased number of steps. Accordingly, the gain after the power-on changes moderately. This avoids sharp increase in signal level to prevent the user from getting a feeling of strangeness. The first time and the second time can be set equal to each other. This setting allows simplification of control operations.

A loudspeaker (2) according to an embodiment of the present disclosure includes: a microphone (16) configured to covert sound into an electric signal; a signal processing unit (20) including a gain setting unit (20*a*) to provide a gain to a first signal generated based on an output signal from the microphone to generate a second signal; a speaker (22) configured to covert the second signal into sound; a feedback removal unit including an adaptive filter (12) configured to adaptively estimate a transfer function corresponding to a pathway from an input side of the speaker to an output side of the microphone through transmission of the sound, a coefficient update unit (13) configured to update a filter coefficient of the adaptive filter based on the first signal and the second signal and a subtraction unit (14) configured to subtract a third signal generated based on the transfer function from the output signal of the microphone to obtain a signal and output the signal as the first signal; and a control unit (11) configured to control at least the gain setting unit and an adaptive speed of the adaptive filter, wherein the coefficient update unit updates the filter coefficient based on an amount of updating normalized by power of input, and the control unit sets a smaller gain than a gain under normal operation to the gain setting unit until a first time has elapsed since immediately after power-on and sets a higher adaptive speed than an adaptive speed under normal operation to the adaptive filter until a second time has elapsed since immediately after the power-on.

A feedback canceller according to an embodiment of the present disclosure includes: a gain setting unit configured to provide a gain to a first signal generated based on an output signal from a first conversion device converting sound into an electric signal to generate a second signal; a feedback removal unit including: an adaptive filter configured to adaptively estimate a transfer function corresponding to a pathway from an input side of a second conversion device converting an electric signal into sound to an output side of the first conversion device through transmission of the sound; a coefficient update unit configured to update a filter coefficient of the adaptive filter based on the first signal and the second signal; and a subtraction unit configured to subtract a third signal generated based on the transfer function from the output signal of the first conversion device to obtain a signal and output the signal as the first signal; and a control unit configured to control at least the gain setting unit and an adaptive speed of the adaptive filter, wherein the coefficient update unit updates the filter coefficient based on an amount of updating normalized by power of input, the control unit sets a smaller gain than a gain under normal operation to the gain setting unit until a first time has elapsed since immediately after power-on, and sets a higher adaptive speed than an adaptive speed under normal operation to the adaptive filter until a second time has elapsed since immediately after the power-on. The feedback canceller according to the embodiment of the present disclosure can be incorporated not only into the hearing aids and loudspeakers described above but also into various devices.

As described above, according to the embodiment of the present disclosure, a device such as a hearing aid with a feedback canceller can suppress occurrence of feedback and achieve rapid shift to normal operation provided that it is set a small gain as compared to that under normal operation and increase the adaptive speed of the adaptive filter even in a period of time immediately after power-on during which the estimation of the transfer function by the adaptive filter has not yet converged. This makes it possible to realize devices such as a hearing aid comfortable to the user by relatively simple configurations and controls.

A plurality of embodiments to which the techniques in the present disclosure are applied will be described below with reference to the attached drawings.

[Hearing Aid]

An embodiment of the present disclosure described below is one of examples in which techniques of the present disclosure are applied to a hearing aid. FIG. 1 is a block diagram illustrating a specific example of the configuration of digital signal processing in a hearing aid 1 according to an embodiment of the present disclosure. In the configuration example illustrated in FIG. 1, the hearing aid 1 includes, as components for digital signal processing, a hearing aid processing unit 10 including a gain setting unit 10*a*, a control unit 11 including a feedback suppression control unit 11*a* and a timer 11*b*, an adaptive filter 12, a coefficient update unit 13, a subtraction unit 14, a receiver 15, and a microphone 16. The functions by foregoing components, except for the receiver 15 and the microphone 16, can be implemented through signal processing performed by a digital signal processor (DSP) capable of digital signal processing, for example. Each of the components operates with supply of electric power from a battery (not shown) mounted in the hearing aid 1. Although not shown in FIG. 1, a DA converter is provided at the input side of the receiver 15 to convert a digital signal to an analog signal. In addition, an AD converter is provided at the output side of the microphone 16 to convert an analog signal to a digital signal. The hearing aid 1 illustrated in FIG. 1 may be any of a wide variety of types of hearing aids including an in-the-ear type, behind-the-ear type, body-worn type, and the like.

In the foregoing configuration, the hearing aid processing unit 10 is a device for performing predetermined hearing aid processes adapted to each individual user on an error signal e (n) output from the subtraction unit 14 described later. In addition, the gain setting unit 10*a* of the hearing aid processing unit 10 provides a gain G set by the feedback suppression control unit 11*a* to the error signal e (n) to generate an input signal x (n). In addition to the provision of the gain G by the gain setting unit 10*a*, the hearing aid processes capable of being performed by the hearing aid processing unit 10 include various processes suited to hearing power properties of the user of the hearing aid 1 and/or usage environments, for example, such as multi-band compression, noise reduction, tone control, and output limiting process on the error signal e (n) input into the hearing aid processing unit 10.

The control unit 11 is a device for controlling the entire digital signal processing in the hearing aid 1. The feedback suppression control unit 11*a* of the control unit 11 is a device for controlling a feedback suppression process executed immediately after power-on of the hearing aid 1. The feedback suppression control unit 11*a* outputs a predetermined control signal to the gain setting unit 10*a* and the coefficient update unit 13 based on timing data output from the timer 11*b*. This feedback suppression process is a process for suppressing occurrence of feedback causing discomfort to the user at power-on of the hearing aid 1, by optimally controlling the gain G and the adaptive speed of the adaptive filter 12 within a predetermined period of time after the power-on of the hearing aid 1. Detailed contents of the specific control by the feedback suppression control unit 11*a* will be described later.

The receiver 15 is put in the user's external ear canal, for example. The receiver 15 converts an input signal x (n) as an electric signal into sound and outputs the same to space in the external ear canal. The receiver 15 may be an electrodynamic-type or electromagnetic-type receiver, for example. The microphone 16 collects sound transmitted from the external space of the hearing aid 1, and converts the collected sound into an electric signal and outputs the same as a desired signal d (n). The microphone 16 may be any of a wide variety of types of microphones such as micro electro mechanical systems (MEMS), electrodynamic-type, capacitor type, piezoelectric type, and the like. In the embodiment, transfer function R (z) of the receiver 15 and transfer function M (z) of the microphone 16 are assumed as illustrated in FIG. 1.

Ideally, only external environmental sound is input into the microphone 16. In actuality, however, sound output from the receiver 15 comes from the user's external ear canal into the microphone 16 as feedback sound. In relation to a transmission pathway of the feedback sound, transfer function F (z) ranging from the output side of the receiver 15 to the input side of the microphone 16 is assumed. Accordingly, transfer function P (z) represented by the following formula (1) intervenes between the input signal x (n) input into the receiver 15 and the desired signal d (n) output from the microphone 16:

$$P(z)=R(z)F(z)M(z) \tag{1}$$

Thus, a loop is formed by the pathway represented by the transfer function P (z) in the formula (1) and the electric pathway ranging from the output side of the microphone 16 through the subtraction unit 14 and the hearing aid processing unit 10 to the input side of the receiver 15. Therefore, feedback occurs if a certain oscillation condition is met. The hearing aid 1 in the embodiment can suppress occurrence of feedback by a configuration described later.

The adaptive filter 12 uses a filter coefficient output from the coefficient update unit 13 to perform a filter calculation with adaptive estimation of the transfer function P (z) represented by the formula (1) on the input signal x (n) generated by the hearing aid processing unit 10, thereby to generate an output signal y (n). The adaptive filter 12 may use a finite impulse response (FIR) having a predetermined number of taps (for example, 32 taps), for example. The coefficient update unit 13 calculates a filter coefficient to be supplied to the adaptive filter 12, based on the foregoing error signal e (n) and input signal x (n). In the embodiment, as an adaptive algorithm in the coefficient update unit 13, a normalized least mean square (NLMS) algorithm can be employed, for example.

The NLMS algorithm is generally a method for calculating a filter coefficient to minimize the mean square of signals while optimizing the amount of updating by power of input from past to present. The NLMS algorithm is more advantageous in adaptive speed as compared to a normal LMS algorithm. For example, the updating of a coefficient w (n) by the coefficient update unit 13 can be represented by the following formula (2) using the input signal x (n) and the error signal e (n):

$$w(n+1)=w(n)+2\mu\cdot x(n)\cdot e(n)/Px \tag{2}$$

where μ denotes a step size parameter and Px denotes the average value of power of the input signal x (n).

The formula (2) is characterized in that the adaptive speed becomes higher as the step size parameter μ is larger, but the amount of updating is normalized by the denominator Px. The step size parameter μ is set to a value adapted to temporal changes in the transfer function P (z) under normal operation of the hearing aid 1. In the embodiment, however, it takes time to converge the estimation of the transfer function P (z) immediately after power-on of the hearing aid 1. Accordingly, control is performed to increase the step size parameter μ. This operation will be described later in detail.

The subtraction unit 14 subtracts the output signal y (n) generated by the adaptive filter 12 from the desired signal d (n) output from the microphone 16. The subtraction unit 14 outputs the signal obtained by the subtraction as the foregoing error signal e (n). In this case, the error signal e (n) can be represented by the following formula (3). In the formula (3), the desired signal d (n) corresponds to the output signal from the microphone 16 in the present disclosure, the error signal e (n) corresponds to a first signal in the present disclosure, and the output signal y (n) corresponds to a third signal in the present disclosure.

$$e(n)=d(n)-y(n) \tag{3}$$

In the embodiment, the adaptive filter 12, the coefficient update unit 13, and the subtraction unit 14 integrally serve as a feedback removal unit in the present disclosure. Specifically, if no feedback removal unit is provided in the configuration illustrated in FIG. 1, the sound from the receiver 15 reaches the microphone 16 through the transmission pathway represented by the transfer function F (z) as described above. Then, feedback occurs when the sound returns to the receiver 15 through the hearing aid processing unit 10 to meet the certain condition. In the embodiment, by the action of the foregoing feedback removal unit, a signal component corresponding to the feedback sound from the receiver 15 to the microphone 16 can be generated according to the formula (3) and removed from the output signal of the microphone 16. This makes it possible to suppress occurrence of feedback. However, the estimation by the adaptive filter 12 has not yet sufficiently converged immediately after the power-on of the hearing aid 1, and thus feedback may occur temporarily. Accordingly, in the embodiment, a measure which is different from that under normal operation is taken immediately after power-on of the hearing aid 1.

Figure 2:
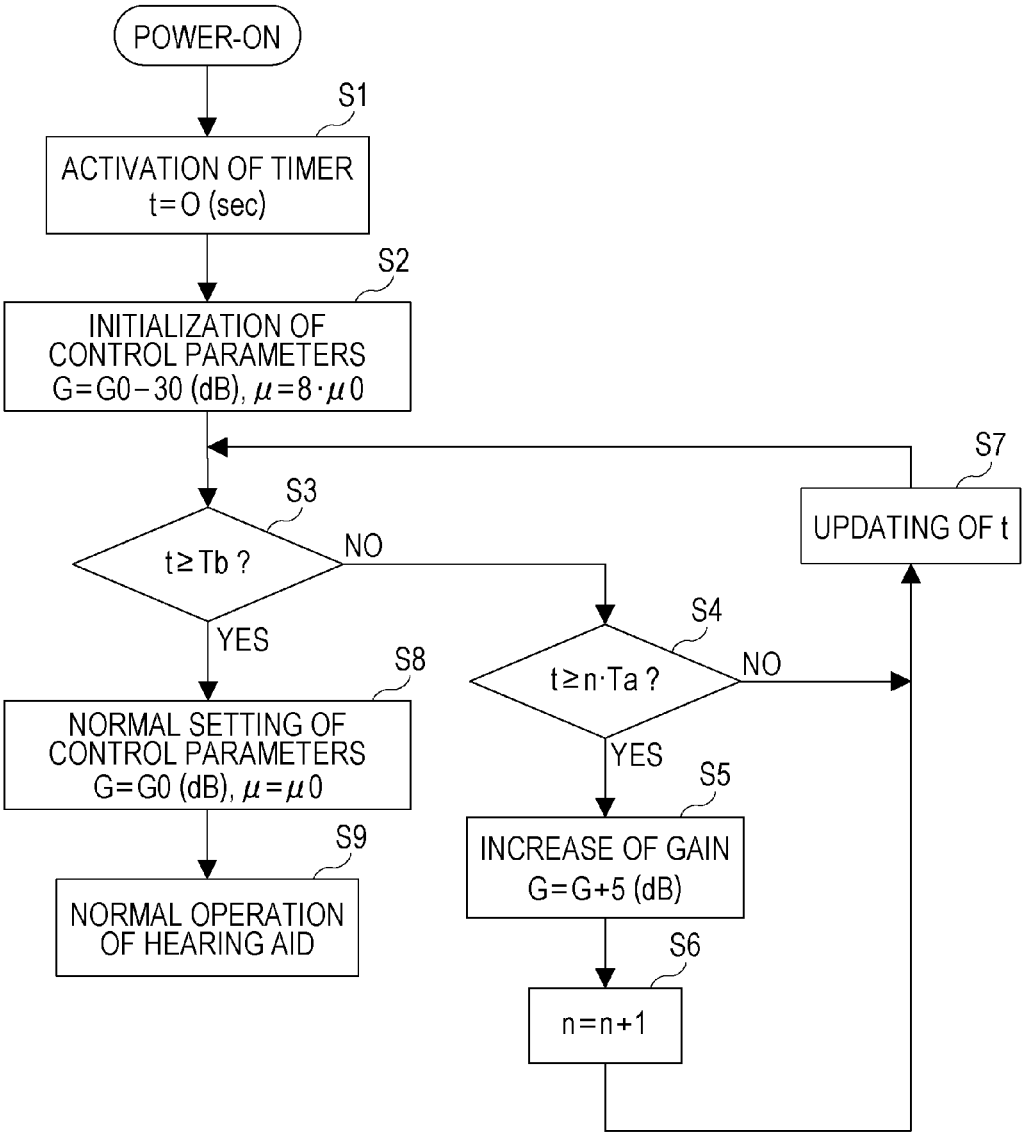
FIG. 2 is a flowchart of a specific example of a feedback suppression process executed under control of a feedback suppression control unit illustrated in FIG. 1 after power-on of the hearing aid in the embodiment.
Figure 3:
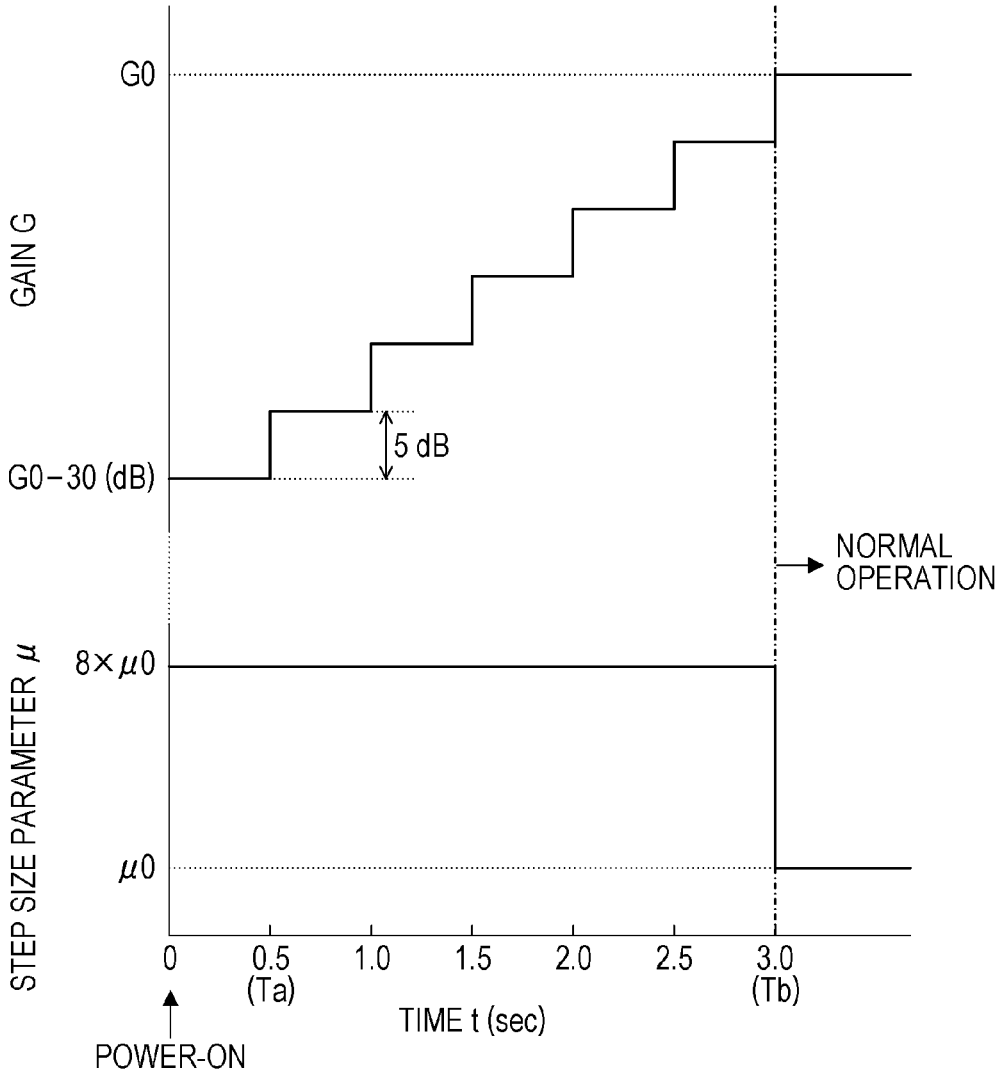
FIG. 3 is a diagram illustrating changes with time in a gain set to a gain setting unit and a step size parameter set to a coefficient update unit, as control parameters in the feedback suppression process.

Next, a feedback suppression process at power-on of the hearing aid 1 in the embodiment will be described with reference to FIGS. 2 and 3. FIG. 2 is a flowchart of a specific example of the feedback suppression process executed under control of the feedback suppression control unit 11*a* illustrated in FIG. 1 after power-on of the hearing aid 1 in the embodiment. FIG. 3 is a diagram illustrating changes with time in the gain G set to the gain setting unit 10*a* and the step size parameter μ set to the coefficient update unit 13, as control parameters in the feedback suppression process.

As illustrated in FIG. 2, when the hearing aid 1 is powered on, the timer 11*b* (FIG. 1) is activated to measure an elapsed time t from that timing as a starting point (step S1). The following description is based on the assumption that the time measurement starts from t=0 second at step S1. Subsequently, the foregoing gain G and step size parameter μ as the control parameters are initialized. Further, n to be used in determination at step S4 described later is initialized (n=1) (step S2). At step S2, for example, if it is assumed that a gain G0 under normal operation is 40 (dB), the gain G is set to G0−30 dB as a corresponding relative value. In addition, for example, it is assumed that a step size parameter μ0 under normal operation as a reference is multiplied by an 8-fold magnification to set μ=8·μ0. By the initialization at step S2, the gain G is sufficiently small immediately after the power-on to make feedback less prone to occur, and μ in the formula (2) is sufficiently large to make the adaptive speed of the adaptive filter 12 higher.

Next, it is determined whether the elapsed time t measured by the timer 11*b* has reached a setting time Tb (first and second times in the present disclosure) defining the timing for switching the gain G and the control parameters to the settings under normal operation (step S3). For example, the setting time Tb is set to 3 (seconds). When it is determined at step S3 that the elapsed time t has not reached the setting time Tb (step S3: NO), it is then determined whether the elapsed time t has reached a predetermined time n·Ta to be updated at each setting time Ta defining the timing for increasing the gain G (step S4). For example, the setting time Ta is set to 0.5 (seconds). When it is determined at step S4 that the elapsed time t has reached the time n·Ta (step S4: YES), the gain G is increased by a predetermined value (step S5), the value of n to be used in determination at step S4 is updated (step S6). Then, the process moves to step S7. On the other hand, when it is determined at step S4 that the elapsed time t has not reached the time n·Ta (step S4: NO), the process moves to step S7 without performing steps S5 and S6. At step S7, the elapsed time t is updated (step S7). Then, the process returns to step S3.

In the example of FIG. 2, it is assumed that, when the process moves to step S5, the gain G is increased by 5 dB. For example, if step S5 is performed for the first time in the situation where the gain G is initially set to G0−30 dB, the gain G is increased by 5 dB and set to G0−25 dB. In addition, for example, after the first-time execution of step S5 and the subsequent steps, step S5 is performed for the second time after a lapse of t=1 (second). In this case, the gain G is increased by 5 dB at step S5 after each lapse of 0.5 seconds. In the embodiment, as described above, it is assumed that the first and second times are set to the equal time (setting time Tb). However, the first and second times may be set to different times.

On the other hand, when it is determined at step S3 that the elapsed time t has reached the setting time Tb (step S3: YES), the gain G and the step size parameter μ as the control parameters are switched to their respective setting values under normal operation (step S8). At step S8, as described above, the gain G and the step size parameter μ are set to G0 and μ0, respectively. As compared to the setting example described in relation to step S2, the gain G is increased by 30 dB and the step size parameter μ is decreased to ⅛. Subsequently, the hearing aid 1 shifts to the normal operation (step S9). The feedback suppression process is continuously performed using the control parameters set at step S8.

By applying (performing) the feedback suppression process illustrated in FIG. 2, the gain G and the step size parameter μ change as illustrated in FIG. 3, for example, for a period of time between power-on and shift to the normal operation. First, the gain G is set to G0−30 (dB) at the time of power-on (t=0). The gain G is increased stepwise by 5 dB at each lapse of 0.5 seconds. Then, it is understood that, when a shift takes place to the normal operation after a lapse of 3 seconds, the gain G becomes G0. Meanwhile, the step size parameter μ is set to 8·μ0 at the time of power-on (t=0). The value of the step size parameter μ is kept until a lapse of 3 seconds. Then, it is understood that, when a shift takes place to the normal operation after a lapse of 3 seconds, the step size parameter μ sharply decreases to μ0.

The estimation of the transfer function P (z) by the adaptive filter 12 does not converge in the time period from immediately after power-on to a lapse of the time Tb, and thus feedback is prone to occur. The hearing aid 1 in the embodiment performs control to decrease the gain G of the gain setting unit 10*a* in this time period. This allows the hearing aid 1 (or the control unit 11) to decrease the total gain in the loop described above with reference to FIG. 1 to prevent or suppress occurrence of feedback. In addition, the hearing aid 1 (or the control unit 11) performs control to sufficiently increase the step size parameter μ in this time period. This allows the hearing aid 1 (or the control unit 11) to increase the adaptive speed of the adaptive filter 12 to bring the estimation of the transfer function P (z) closer to convergence quickly. After a lapse of the time Tb, when the gain G becomes G0 and the step size parameter μ of the adaptive filter 12 becomes μ0, the estimation of the adaptive filter 12 is already sufficiently close to convergence, and thus it is possible to allow the estimation of the adaptive filter 12 to converge quickly. The step size parameter μ may be changed in two stages as illustrated in FIG. 3. A large amount of change in the gain G would provide the user with a feeling of strangeness. Thus, as illustrated in FIG. 3, the gain G is desirably controlled to form a gentle waveform such as a stepwise waveform. However, there is no limitation on change patterns for the gain G and the step size parameter μ as far as the object of the present disclosure can be attained. A wide variety of change patterns can be used.

Figure 4A:
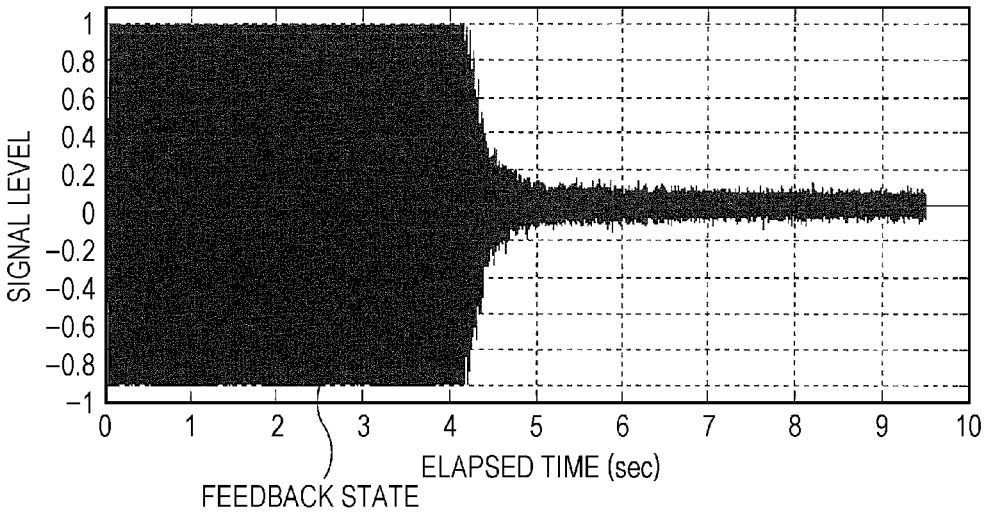
FIGS. 4A and 4B are diagrams illustrating effects of executing the feedback suppression process immediately after power-on of the hearing aid in the embodiment.
Figure 4B:
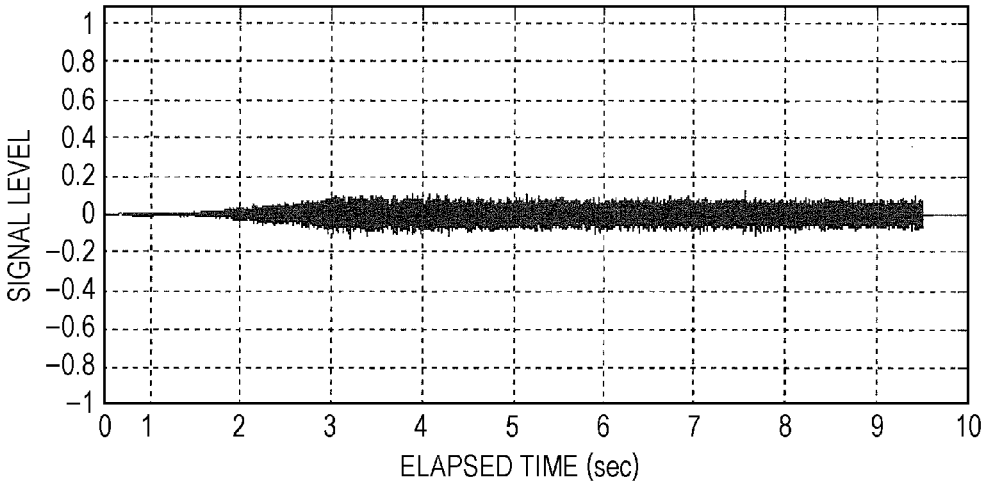

Next, effectiveness of the feedback suppression process by the hearing aid 1 in the embodiment at the time of power-on will be described with reference to FIGS. 4A and 4B. For comparison with the embodiment, FIG. 4A illustrates a sound signal waveform obtained by a simulation in which the feedback suppression process under normal operation is executed immediately after power-on, instead of the feedback suppression process illustrated in FIG. 2. FIG. 4B illustrates a sound signal waveform obtained by a simulation in which the feedback suppression process illustrated in FIG. 2 is executed immediately after power-on under the same environmental conditions as those in the case of FIG. 4A. In the example of FIG. 4B, the control parameters are set as G=G0−30 dB and μ=16·μ0 until a lapse of 3 seconds after the power-on. After the lapse of 3 seconds, the control parameters are set as G=G0 and μ=μ0. It is obvious that feedback has occurred immediately after the power-on in the case of FIG. 4A, and feedback has been suppressed in the case of FIG. 4B. By these simulations, it is confirmed that the application of the feedback suppression process illustrated in FIG. 2 is sufficiently effective.

[Loudspeaker]

Figure 5:
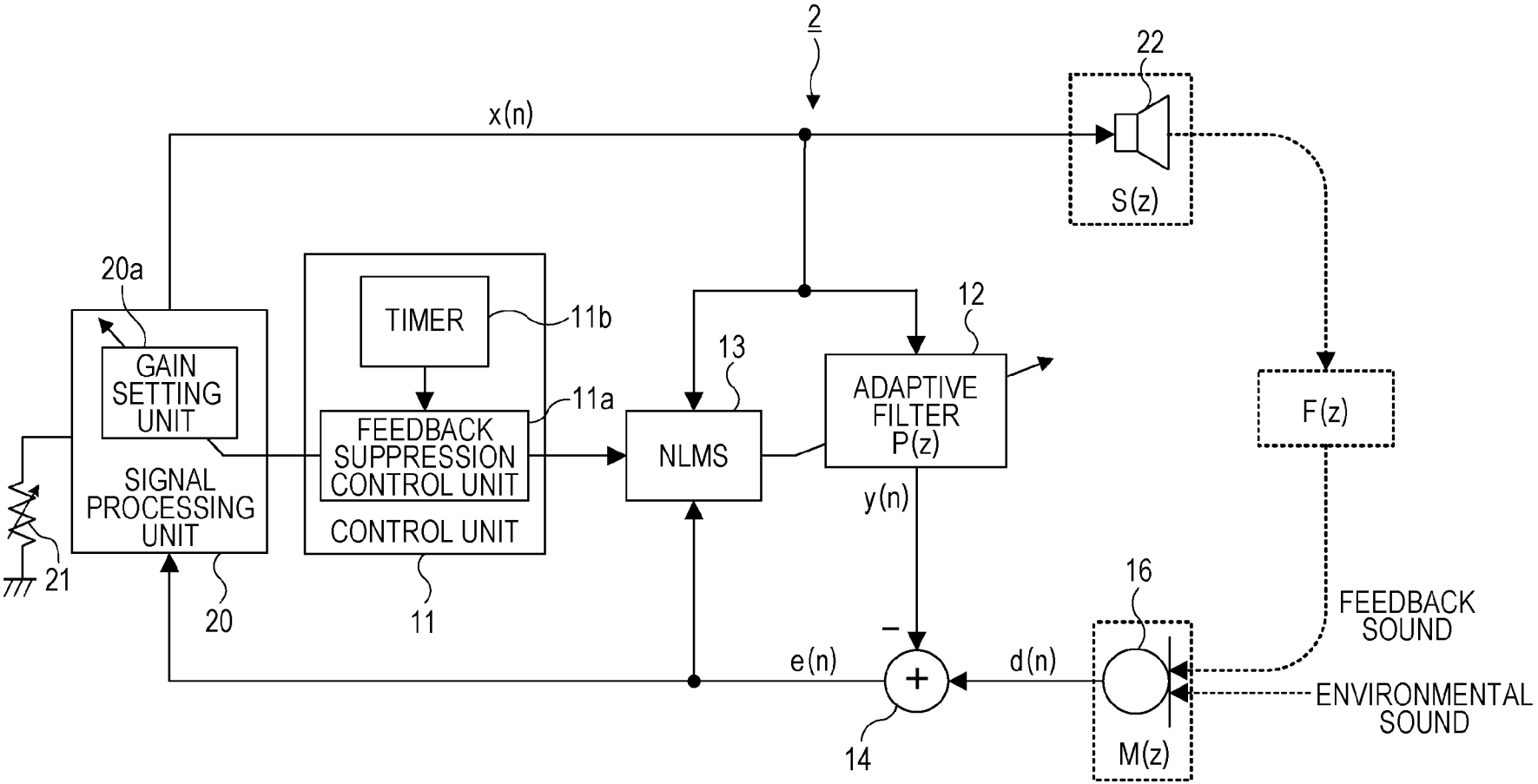
FIG. 5 is a block diagram illustrating the scope of an example of specific configuration of a loudspeaker in an embodiment related to digital signal processing, applicable to the configuration example of the hearing aid illustrated in FIG. 1.

The following embodiment is an example in which the present disclosure is applied to a loudspeaker. FIG. 5 is a block diagram illustrating the scope of an example of specific configuration of a loudspeaker 2 in an embodiment related to digital signal processing, applicable to the configuration example of the hearing aid 1 illustrated in FIG. 1. With reference to FIG. 5, the control unit 11 including the feedback suppression control unit 11*a* and the timer 11*b*, the adaptive filter 12, the coefficient update unit 13, the subtraction unit 14, and the microphone 16 are the same as those illustrated in FIG. 1, and thus descriptions thereof will be omitted. Meanwhile, the hearing aid processing unit 10 illustrated in FIG. 1 is replaced by a signal processing unit 20 illustrated in FIG. 5. The signal processing unit 20 can perform a wide variety of signal processes according to the functionality of the loudspeaker 2 such as noise removal function, for example. A gain setting unit 20*a* in the signal processing unit 20 is the same as the gain setting unit 10*a* illustrated in FIG. 1. In addition, the signal processing unit 20 is connected to a sound volume adjustment unit 21 including a variable resistance for a user to adjust the volume of sound from the loudspeaker 2. Further, the receiver 15 illustrated in FIG. 1 is replaced by a speaker 22 illustrated in FIG. 5. A power amplifier (not shown) may be inserted into the input side of the speaker 22. As in the foregoing, the feedback suppression process at the time of power-on described above with reference to FIGS. 2, 3, 4A, and 4B can also be introduced to the loudspeaker 2 illustrated in FIG. 5. In this case, the same effects as those in the case of the hearing aid 1 can be obtained. However, it is to be desired the control parameters and the like are set appropriately, taking into account differences in circuitry conditions and transmission pathways of sound between the hearing aid 1 and the loudspeaker 2.

[Feedback Canceller]

In the foregoing embodiments, techniques of the present disclosure (for example, the feedback suppression process at the time of power-on) are applied to the hearing aid 1 and the loudspeaker 2. However, the present disclosure is not limited thereto but can be applied to various other devices. Specifically, the techniques of the present disclosure can be applied to any device as an independent one or as one incorporated into another device, provided that it is a device (feedback canceller) configured as illustrated in FIG. 1 or 5 and capable of performing the process illustrated in FIG. 2. In such a feedback canceller, as far as occurrence of feedback immediately after power-on of the device can be suppressed, a wide variety of selections are possible for the configuration of the hearing aid processing unit 10 (refer to FIG. 1) or the signal processing unit 20 (refer to FIG. 5), settings of the control parameters, and the like.

As in the foregoing, the contents of the present disclosure are specifically described with reference to the embodiments. However, these embodiments do not limit the present disclosure. These embodiments can be modified in various manners without deviating from the essence of the techniques of the present disclosure. For example, in the embodiments of FIGS. 1 and 5, the NLMS algorithm is employed as the adaptive algorithm of the coefficient update unit 13. As far as the object of the present disclosure can be attained, a normal LMS algorithm or any of other various adaptive algorithms can be employed as the adaptive algorithm of the coefficient update unit 13. In addition, the specific configuration illustrated in FIG. 1 or 5 and the control method illustrated in FIG. 2 are not limited to the contents of the embodiments. It is to be understood that various configurations and controls can be employed as the foregoing configuration and control.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A hearing aid, comprising:

a microphone configured to convert sound into an electric signal;

a hearing aid processing unit including a gain setting unit configured to provide a gain to a first signal generated based on an output signal from the microphone to generate a second signal;

a receiver configured to convert the second signal into sound;

a feedback removal unit including an adaptive filter configured to adaptively estimate a transfer function corresponding to a pathway from an input side of the receiver to an output side of the microphone through transmission of the sound, a coefficient update unit configured to update a filter coefficient of the adaptive filter based on the first signal and the second signal and a subtraction unit configured to subtract a third signal generated based on the transfer function from the output signal of the microphone to obtain a signal and output the signal as the first signal; and a control unit configured to control at least the gain setting unit and an adaptive speed of the adaptive filter, wherein the coefficient update unit updates the filter coefficient based on an amount of updating normalized by power of input, and the control unit sets a smaller gain than a gain under normal operation to the gain setting unit until a first time has elapsed since immediately after power-on and sets a higher adaptive speed than an adaptive speed under normal operation to the adaptive filter until a second time has elapsed since immediately after the power-on.

2. The hearing aid according to claim 1, wherein the coefficient update unit updates the filter coefficient of the adaptive filter according to an NLMS algorithm.

3. The hearing aid according to claim 1, wherein the control unit controls the gain-setting unit to sequentially increase a gain until the first time has elapsed since immediately after the power-on.

4. The hearing aid according to claim 2, wherein the control unit controls the gain-setting unit to sequentially increase a gain until the first time has elapsed since immediately after the power-on.

5. The hearing aid according to claim 1, wherein the first time and the second time are set equal to each other.

6. The hearing aid according to claim 2, wherein the first time and the second time are set equal to each other.

7. The hearing aid according to claim 3, wherein the first time and the second time are set equal to each other.

8. The hearing aid according to claim 4, wherein the first time and the second time are set equal to each other.

9. A loudspeaker, comprising:

a microphone configured to covert sound into an electric signal;

a signal processing unit including a gain setting unit to provide a gain to a first signal generated based on an output signal from the microphone to generate a second signal;

a speaker configured to covert the second signal into sound;

a feedback removal unit including: an adaptive filter configured to adaptively estimate a transfer function corresponding to a pathway from an input side of the speaker to an output side of the microphone through transmission of the sound, a coefficient update unit configured to update a filter coefficient of the adaptive filter based on the first signal and the second signal and a subtraction unit configured to subtract a third signal generated based on the transfer function from the output signal of the microphone to obtain a signal and output the signal as the first signal; and a control unit configured to control at least the gain setting unit and an adaptive speed of the adaptive filter, wherein the coefficient update unit updates the filter coefficient based on an amount of updating normalized by power of input, and the control unit sets a smaller gain than a gain under normal operation to the gain setting unit until a first time has elapsed since immediately after power-on and sets a higher adaptive speed than an adaptive speed under normal operation to the adaptive filter until a second time has elapsed since immediately after the power-on.

10. A feedback canceller, comprising:

a gain setting unit configured to provide a gain to a first signal generated based on an output signal from a first conversion device that configured to convert sound into an electric signal to generate a second signal;

a feedback removal unit including: an adaptive filter configured to adaptively estimate a transfer function corresponding to a pathway from an input side of a second conversion device that configured to convert an electric signal into sound to an output side of the first conversion device through transmission of the sound, a coefficient update unit configured to update a filter coefficient of the adaptive filter based on the first signal and the second signal and a subtraction unit configured to subtract a third signal generated based on the transfer function from the output signal of the first conversion device to obtain a signal and output the signal as the first signal; and a control unit configured to control at least the gain setting unit and an adaptive speed of the adaptive filter, wherein the coefficient update unit updates the filter coefficient based on an amount of updating normalized by power of input, and the control unit sets a smaller gain than a gain under normal operation to the gain setting unit until a first time has elapsed since immediately after power-on and sets a higher adaptive speed than an adaptive speed under normal operation to the adaptive filter until a second time has elapsed since immediately after the power-on.

* * * * *